US008956168B2

(12) United States Patent
Al-Anzi

(10) Patent No.: US 8,956,168 B2
(45) Date of Patent: Feb. 17, 2015

(54) ELECTRICAL OUTLET SAFETY DEVICE

(71) Applicant: Kuwait University, Safat (KW)

(72) Inventor: Bader Shafaqa Al-Anzi, Safat (KW)

(73) Assignee: Kuwait University, Safat (KW)

( * ) Notice: Subject to any disclaimer, the term of this patent is extended or adjusted under 35 U.S.C. 154(b) by 93 days.

(21) Appl. No.: 13/894,378

(22) Filed: May 14, 2013

(65) Prior Publication Data

US 2014/0342590 A1 Nov. 20, 2014

(51) Int. Cl.
*H01R 13/66* (2006.01)
*H01R 13/635* (2006.01)

(52) U.S. Cl.
CPC ..... *H01R 13/6683* (2013.01); *H01R 13/635* (2013.01)
USPC ..... 439/159

(58) Field of Classification Search
USPC ..... 439/152, 155, 159, 153, 163, 160
See application file for complete search history.

(56) References Cited

U.S. PATENT DOCUMENTS

| | | | | | |
|---|---|---|---|---|---|
| 2,427,390 | A | * | 9/1947 | Dear | 337/62 |
| 2,612,419 | A | * | 9/1952 | Reynolds | 92/94 |
| 2,688,734 | A | * | 9/1954 | Welling | 439/159 |
| 2,696,594 | A | * | 12/1954 | Harrington et al. | 439/160 |
| 3,168,805 | A | * | 2/1965 | Fleury | 60/531 |
| 3,475,715 | A | | 10/1969 | Venaleck | |
| 3,609,635 | A | * | 9/1971 | Harris | 60/520 |
| 3,737,835 | A | * | 6/1973 | Clement et al. | 439/155 |
| 3,784,958 | A | * | 1/1974 | Harris | 439/159 |
| RE28,545 | E | * | 9/1975 | Harris | 60/520 |
| 4,326,763 | A | * | 4/1982 | Ristovski | 439/108 |
| 4,750,890 | A | * | 6/1988 | Dube et al. | 439/152 |
| 4,828,542 | A | * | 5/1989 | Hermann | 604/3 |
| 5,137,658 | A | * | 8/1992 | Stahl | 252/606 |
| 5,293,296 | A | | 3/1994 | Carl | |
| 5,480,314 | A | * | 1/1996 | Campbell | 439/159 |
| 6,029,686 | A | * | 2/2000 | Pirkle | 137/62 |
| 6,189,479 | B1 | * | 2/2001 | Hudson | 116/217 |
| 6,204,747 | B1 | | 3/2001 | Kitchens | |
| 6,278,826 | B1 | * | 8/2001 | Sheu | 385/109 |
| 6,540,533 | B1 | | 4/2003 | Schreiber | |
| 6,913,475 | B2 | * | 7/2005 | Hsu | 439/160 |
| 7,316,518 | B2 | * | 1/2008 | Sasaki et al. | 403/344 |
| 7,344,393 | B2 | * | 3/2008 | Buller et al. | 439/152 |
| 7,402,051 | B1 | * | 7/2008 | Batish et al. | 439/66 |
| 7,465,174 | B1 | * | 12/2008 | Haggis et al. | 439/153 |
| 7,628,626 | B1 | * | 12/2009 | Tseng | 439/160 |
| 8,576,034 | B2 | * | 11/2013 | Bilbrey et al. | 335/285 |
| 2008/0242134 | A1 | * | 10/2008 | Wandler | 439/181 |
| 2008/0261420 | A1 | | 10/2008 | Riddle | |
| 2011/0003494 | A1 | * | 1/2011 | Tang | 439/149 |

* cited by examiner

*Primary Examiner* — Alexander Gilman
(74) *Attorney, Agent, or Firm* — Richard C Litman

(57) ABSTRACT

The electrical outlet safety device is placed between an electrical plug and the corresponding electrical outlet or receptacle to which the plug is connected. The safety device includes a thin body portion formed of a material adapted to expand rapidly if exposed to a predetermined temperature. A series of thin, electrically and thermally conductive blades extends from the body, with the blades being captured between the prongs of the plug and the internal contacts of the receptacle when installed therewith. If excessively high electrical resistance and correspondingly high temperature are produced in one or more of the electrical connections between the plug and the outlet, the blades of the safety device transmit the excessive temperature to the body, whereupon the body is transformed to an expansive electrically insulating foam that expels the plug from the receptacle. Springs may be included within the body to provide additional expansive force.

19 Claims, 3 Drawing Sheets

ELECTRICAL OUTLET SAFETY DEVICE

BACKGROUND OF THE INVENTION

1. Field of the Invention

The present invention relates generally to electrical distribution systems, and particularly to an electrical outlet safety device that automatically separates an electrical plug or the like from an electrical receptacle or outlet in the event that excessive electrical current flows through the plug and receptacle.

2. Description of the Related Art

The modern world is becoming ever more dependent upon various electrical and electronic devices for use both in the home and in the workplace. Nearly all contemporary structures include extensive electrical systems configured to supply any reasonable need for electrical power to a number of built-in and portable electrical devices and appliances installed and placed in the structures.

The design of electrical systems to provide a safe supply of electrical energy for anticipated electrical loads is a well-established field. As long as the electrical loads are maintained within the anticipated and expected limits and the electrical systems and any electrical devices connected thereto are maintained in good working order, such systems are quite safe and operate without hazard. However, improperly maintained electrical devices, loose or corroded electrical connections, and other problems can occasionally result in some hazard to the structure in which the electrical system is installed.

One problem that occurs from time to time is a poor electrical connection between an electrical plug and its outlet or receptacle. The prongs or blades of an electrical plug are configured to make good electrical contact with the corresponding contacts within a corresponding electrical outlet, but over time, the outlet contacts may lose their resilience and only loosely contact the prongs or blades of the electrical plug. Wiring attachment screws and connectors may also loosen over time. Either condition results in relatively high resistance in the electrical outlet and/or plug. This is particularly critical where relatively high amperage appliances are connected to the electrical outlet. It is well known that electrical resistance produces heat, which is proportional to the electrical resistance. Sufficient resistance has been known to create sufficient heat to start a fire, which is clearly a disastrous outcome.

Thus, an electrical outlet safety device solving the aforementioned problems is desired.

SUMMARY OF THE INVENTION

The electrical outlet safety device includes a flat body that is installed between an electrical plug and a corresponding electrical receptacle or outlet. The safety device includes a plurality of thin electrically conductive blades extending from the body, corresponding to the blades of the electrical plug. The blades are captured between the prongs of the electrical plug and the corresponding internal terminals of the outlet or receptacle to provide better electrical contact and to conduct heat generated by poor contact or high resistance to the body of the safety device.

The thin blades also provide electrical contacts for an amperage measuring device disposed within the body of the safety device. The amperage measuring device is preset at a predetermined amperage to cause the body of the safety device to expel the electrical plug from the outlet, thereby breaking the current flow. The thermally conductive blades also transfer heat to a thermal sensor, which causes the body of the safety device to expel the plug in the event that an excessive temperature is reached.

The body of the device is formed of a compressed fire retardant material having a configuration congruent to that of the face of the electrical plug with which it is to be used to provide an unobtrusive appearance when installed. The material of which the body of the device is made is configured to expand rapidly, i.e., to produce a small explosion, when a predetermined temperature is reached, as transmitted by the thin blades captured between the prongs of the plug and the internal contacts of the receptacle. Compressive springs may be provided within the body of the device, so that the springs release to push the plug from the outlet when the body of the device expands. The material of which the body of the device is made becomes an electrically insulating foam material as it expands, and may release a smoke-like vapor to provide a visual indication of actuation. The expansive force of the foam and the springs ejects the plug from the receptacle to break the electrical contact, thus terminating the generation of heat due to the electrical resistance within the plug and receptacle connection.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The electrical outlet safety device is adapted for removable installation between a conventional electrical plug and conventional electrical receptacle or outlet. The safety device provides for the separation of the plug from the outlet in the event that excessively high amperage or resistance and heating occur in the outlet and/or outlet and plug interface.

Figure 1:
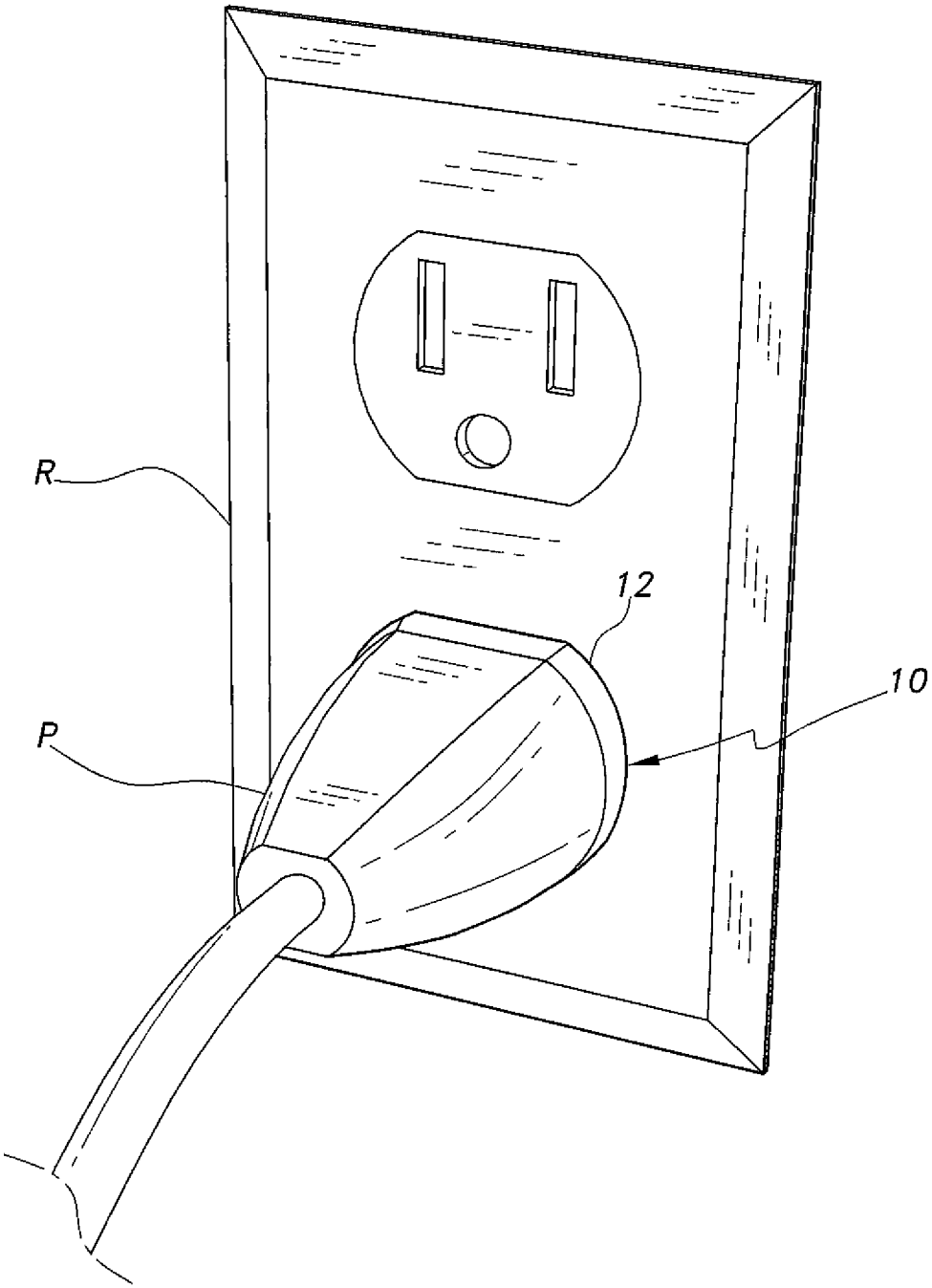
FIG. 1 is an environmental perspective view of an electrical outlet safety device according to the present invention, illustrating its installation between an electrical outlet and plug.
Figure 2:
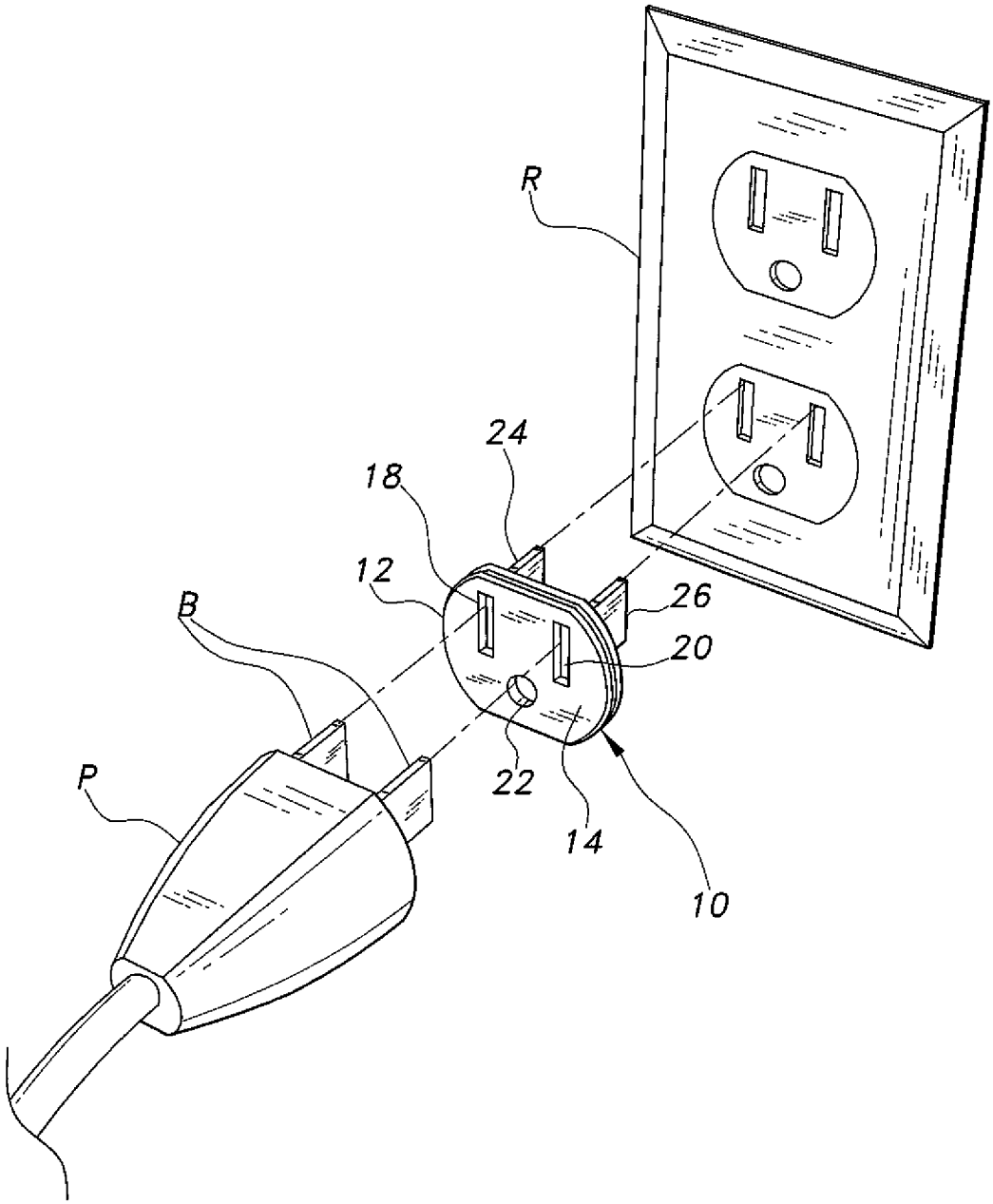
FIG. 2 is an exploded environmental perspective view of the electrical outlet safety device according to the present invention, showing the device positioned between the separated plug and outlet.

FIG. 1 of the drawings is an environmental perspective view, showing the electrical outlet safety device 10 installed between a conventional electrical plug P and conventional electrical outlet or receptacle R. FIG. 2 provides an exploded perspective view of the safety device 10, plug P, and receptacle R. The safety device 10 comprises a thin, flat body 12 having a plug face 14, i.e., the face adjacent to the plug P when installed therewith, and an opposite receptacle face 16, i.e., the face adjacent to the receptacle R when installed therewith, as shown in profile in FIG. 3. The body 12 of the safety device 10 is preferably formed to be congruent with the configuration of the face of the plug P, as shown in FIG. 1, in order to provide an unobtrusive appearance. The device 10, or more particularly, the body 12 thereof further includes a plurality of passages therethrough, comprising a first blade or prong passage 18, second blade or prong passage 20, and ground pin passage 22, corresponding to the conventional blades or prongs B and ground pin extending from a conventional electrical plug P.

A corresponding plurality of electrical contacts extends from the receptacle face 16 of the body 12, including a first contact 24 corresponding to the first blade receptacle 18, a second contact 26 corresponding to the second blade receptacle 20, and a third contact corresponding to the ground pin receptacle 22. Each of these electrical contacts comprises a thin, thermally and electrically conductive element extending from the receptacle face 16 of the body 12 immediately adjacent its corresponding passage and normal to the receptacle face 16. The electrical contacts are preferably formed of a thermally and electrically conductive material, such as brass or other suitable material, and are sufficiently thin to fit between the blades B and ground pin of the plug P and the corresponding internal contacts conventionally found in an electrical receptacle. The electrical contacts, e.g., contacts 24 and 26, thus provide for electrical and thermal communication between the internal contacts of the receptacle R and the blades or prongs B and ground pin of the plug P.

Figure 3:
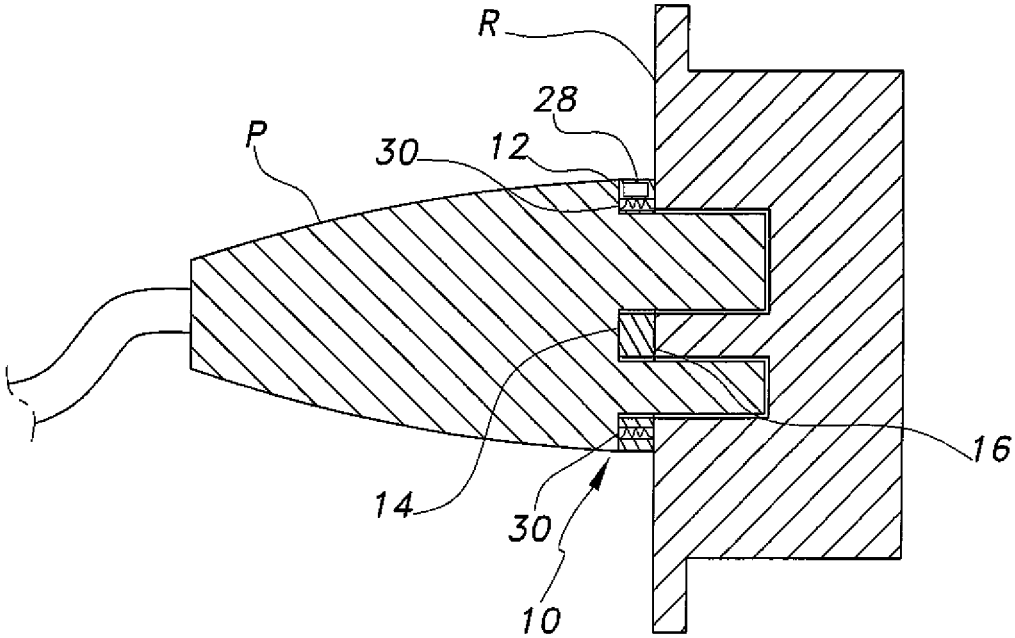
FIG. 3 is an environmental elevation view in section of the electrical outlet safety device according to the present invention, showing the device installed between an electrical plug and outlet.

The body 12 of the electrical outlet safety device 10 includes an amperage and temperature sensor 28 therein, as indicated in the cross-sectional view of FIG. 3. The amperage and temperature sensor 28 is a miniaturized unit of conventional construction, communicating electrically and thermally with the electrical contacts 24 and 26 and the ground pin contact. The electrical and thermal communication may be by direct physical contact, conventional wiring, etc. In addition, one or more compressive springs 30 may be installed between the two faces 14 and 16 of the body 12, as shown in FIG. 3. These springs 30 are held in their compressed state by the solid body 12 during normal operation of the electrical outlet safety device 10. The springs 30 may be in electrical communication with the amperage and temperature sensor 28. The springs 30 are released to force the plug P from the receptacle R when the amperage through the plug P and receptacle R reaches some predetermined point, as sensed by the amperage and temperature sensor 28.

Figure 4:
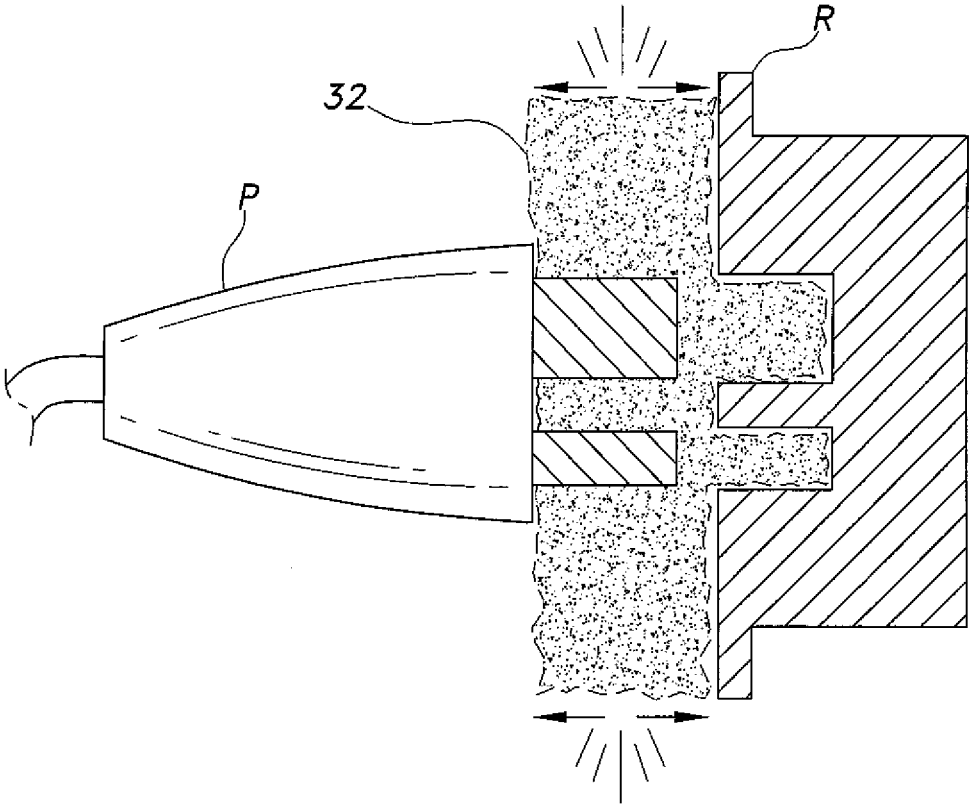
FIG. 4 is an environmental elevation view in section of the electrical plug being expelled from the outlet as the electrical outlet safety device according to the present invention separates the plug and outlet from one another.

The body 12 of the safety device 10 is formed of a compressed material that is solid when compressed to form a plastic-like material for the body 12. The material expands rapidly when subjected to certain predetermined temperature and/or amperage conditions, as communicated to the amperage and temperature sensor unit 28 from the contacts 24 and 26. This rapid expansion, or minor explosion, of the body 12 material results in the ejection of the plug P from the receptacle R, as shown in FIG. 4 of the drawings. The expanded material 32, shown in FIG. 4, preferably forms an electrically insulating foam when expanded, as shown in FIG. 4, and this material also acts as a fire extinguishing agent. Such materials are known and conventional. The material may also emit a colored smoke, vapor, and/or telltale scent or odor when activated by excessive amperage and/or heat in order to alert persons in the vicinity. The result, in any event, is separation of the plug P from the receptacle R, thus terminating the high resistance connection between the two and the corresponding heat produced by such high resistance.

While the electrical outlet safety device 10 is illustrated as having a configuration compatible with conventional US electrical plugs and outlets of 115-volt nominal rating, it should be noted that the safety device may be constructed to be compatible with virtually any standard or conventional plug and outlet or receptacle configuration and electrical rating, as desired. Also, the safety device 10 may also include a short range, low power transmitter to transmit a signal to a receiver in order to provide an alert to persons that the amperage and/or temperature is approaching the predetermined limit for actuating the device, to allow someone to remove the plug from the receptacle prior to actuation of the device.

It is to be understood that the present invention is not limited to the embodiments described above, but encompasses any and all embodiments within the scope of the following claims.

I claim:

1. An electrical outlet safety device for removable installation between an electrical plug and an electrical receptacle, the safety device comprising:

a thin, flat body portion having a plug face;

a receptacle face opposite the plug face;

a plurality of passages therethrough, the passages corresponding to the prongs of an electrical plug, the body portion being made from compressed material adapted to expand rapidly upon reaching a predetermined temperature, thereby forcefully ejecting the electrical plug from the electrical socket when the body portion is installed therebetween;

a plurality of electrical contacts extending from the body portion, the electrical contacts communicating electrically with the electrical plug and the electrical receptacle when the body portion is installed therebetween; and amperage sensing means disposed within the body portion for sensing current flowing through the electrical contacts and for rapidly expanding the compressed material of the body portion when the amperage sensing means senses a predetermined amperage, thereby forcefully ejecting the electrical plug from the electrical socket when the body portion is installed therebetween.

2. The electrical outlet safety device according to claim 1, wherein each of the electrical contacts is thermally conductive, the device further comprising temperature sensing means for sensing the temperature of the electrical contacts and for rapidly expanding the compressed material of the body portion when the temperature sensing means senses a predetermined temperature, thereby forcefully ejecting the electrical plug from the electrical socket when the body portion is installed therebetween.

3. The electrical outlet safety device according to claim 1, further comprising:

an electrically conductive blade adjacent to each of the passages of the body portion, each of the blades extending from the receptacle face and normal thereto;

amperage sensing means disposed within the body portion for sensing the amperage of current flowing through the blades; and at least one spring compressively disposed within the body portion between the plug face and the receptacle face thereof, the spring communicating electrically with the amperage sensing means, the spring expanding rapidly upon reaching a predetermined amperage as sensed by the amperage sensing means, thereby forcefully ejecting the electrical plug from the electrical socket when the body portion is installed therebetween.

4. The electrical outlet safety device according to claim 1, wherein the compressed material of the body portion comprises a fire extinguishing agent.

5. The electrical outlet safety device according to claim 1, wherein the compressed material of the body portion forms an electrically insulating foam upon said rapid expansion.

6. The electrical outlet safety device according to claim 1 wherein the body portion has a periphery substantially congruent with the electrical plug.

7. An electrical outlet safety device for removable installation between an electrical plug and an electrical receptacle, the safety device comprising:

a thin, flat body portion having a plug face, a receptacle face opposite the plug face, and a plurality of passages therethrough, the passages corresponding to the prongs of an electrical plug, the body portion being made from compressed material capable of rapid expansion;

a plurality of electrical contacts extending from the body portion, the electrical contacts communicating electrically with the electrical plug and the electrical receptacle when the body portion is installed therebetween; and amperage sensing means disposed within the body portion for sensing the amperage of current flowing through the electrical contacts and for rapidly expanding the compressed material of the body portion upon reaching a predetermined amperage, thereby forcefully ejecting the electrical plug from the electrical socket when the body portion is installed therebetween.

8. The electrical outlet safety device according to claim 7, wherein the compressed material of the body portion is also adapted to expand rapidly upon reaching a predetermined temperature, thereby forcefully ejecting the electrical plug from the electrical socket when the body portion is installed therebetween.

9. The electrical outlet safety device according to claim 7, wherein the electrical contacts comprise an electrically conductive blade adjacent to each of the passages of the body portion, each blade extending from the receptacle face and normal thereto, the device further comprising at least one spring compressively disposed within the body portion between the plug face and the receptacle face thereof, the spring communicating electrically with the amperage sensing means, the spring expanding rapidly upon reaching a predetermined amperage as sensed by the amperage sensing means, thereby forcefully ejecting the electrical plug from the electrical socket when the body portion is installed therebetween.

10. The electrical outlet safety device according to claim 7, wherein each of the electrical contacts is thermally conductive, the device further comprising temperature sensing means for sensing the temperature of the electrical contacts, the compressed material of the body portion also being adapted to expand rapidly when the temperature sensing means senses a predetermined temperature, thereby forcefully ejecting the electrical plug from the electrical socket when the body portion is installed therebetween.

11. The electrical outlet safety device according to claim 7, wherein the compressed material of the body portion comprises a fire extinguishing agent.

12. The electrical outlet safety device according to claim 7, wherein the compressed material of the body portion forms an electrically insulating foam upon said rapid expansion.

13. The electrical outlet safety device according to claim 7, wherein the body portion has a periphery substantially congruent with the electrical plug.

14. An electrical outlet safety device for removable installation between an electrical plug and an electrical receptacle, the safety device comprising:

a thin, flat body portion having a plug face, a receptacle face opposite the plug face, and a plurality of passages therethrough, the passages corresponding to the prongs of an electrical plug;

an electrically conductive blade adjacent to each of the passages of the body portion, each of the blades extending from the receptacle face normal thereto;

amperage sensing means disposed within the body portion for sensing the amperage of current flowing through the electrical contacts; and at least one spring compressively disposed within the body portion between the plug face and the receptacle face thereof, the spring communicating electrically with the amperage sensing means, the spring expanding rapidly upon reaching a predetermined amperage as sensed by the amperage sensing means, thereby forcefully ejecting the electrical plug from the electrical socket when the body portion is installed therebetween.

15. The electrical outlet safety device according to claim 14, wherein each said blade is thermally conductive and the body portion is made from a compressed material, the device further comprising temperature sensing means for sensing the temperature of the electrical contacts and for rapidly expanding the compressed material of the body portion when the temperature sensing means senses a predetermined temperature, thereby forcefully ejecting the electrical plug from the electrical socket when the body portion is installed therebetween.

16. The electrical outlet safety device according to claim 14, wherein:

each said blade comprises an electrical contact communicating electrically with the electrical plug and the electrical receptacle when the body portion is installed therebetween; and the body portion comprises compressed material adapted to expand rapidly when the amperage sensing means senses a predetermined amperage, thereby forcefully ejecting the electrical plug from the electrical socket when the body portion is installed therebetween.

17. The electrical outlet safety device according to claim 14, wherein the compressed material of the body portion comprises a fire extinguishing agent.

18. The electrical outlet safety device according to claim 14, wherein the compressed material of the body portion forms an electrically insulating foam upon said rapid expansion.

19. The electrical outlet safety device according to claim 14 wherein the body portion has a periphery substantially congruent with the electrical plug.

* * * * *